United States Patent [19]

Odén et al.

[11] Patent Number: 5,020,608

[45] Date of Patent: Jun. 4, 1991

[54] DEVICE FOR BORING HOLES IN THE GROUND

[75] Inventors: Anders Odén, Stocksund; Gunnar Jonsson, Täby, both of Sweden

[73] Assignee: Diamant Boart Craelius AB, Marsta, Sweden

[21] Appl. No.: 435,461

[22] PCT Filed: Aug. 29, 1989

[86] PCT No.: PCT/SE89/00452

§ 371 Date: Nov. 16, 1989

§ 102(e) Date: Nov. 16, 1989

[87] PCT Pub. No.: WO90/02242

PCT Pub. Date: Mar. 8, 1990

[30] Foreign Application Priority Data

Aug. 31, 1988 [CH] Switzerland ..... 8803046

[51] Int. Cl.[5] ..... E21B 7/18; E21B 7/26

[52] U.S. Cl. ..... 175/21; 175/61; 175/67; 175/73; 175/399; 175/400

[58] Field of Search ..... 175/19, 21, 61, 65, 175/67, 73, 74, 398, 399, 408, 400, 424; 299/17

[56] References Cited

U.S. PATENT DOCUMENTS

| | | | |
|---|---|---|---|
| 3,324,957 | 7/1967 | Goodwin | 175/67 |
| 3,365,007 | 1/1968 | Skipper | 175/61 |
| 3,525,405 | 8/1970 | Coyne et al. | 175/61 |
| 3,529,682 | 9/1970 | Coyne | 175/45 |
| 3,746,108 | 7/1973 | Hall | 175/61 |
| 4,119,160 | 10/1978 | Summers et al. | 175/67 |
| 4,306,627 | 12/1981 | Cheung et al. | 175/67 |
| 4,401,170 | 8/1983 | Cherrington | 175/73 |
| 4,416,339 | 11/1983 | Baker et al. | 175/61 |
| 4,620,600 | 11/1986 | Persson | 175/73 |
| 4,621,698 | 11/1986 | Pittard et al. | 175/19 |
| 4,679,637 | 7/1987 | Cherrington et al. | 175/61 |
| 4,725,837 | 2/1988 | Rubin | 340/855 |

FOREIGN PATENT DOCUMENTS

| | | | |
|---|---|---|---|
| 0195559 | 9/1986 | European Pat. Off. . | |
| 3029963 | 10/1985 | Fed. Rep. of Germany . | |
| 117737 | 7/1968 | Norway . | |
| 2126267 | 3/1974 | United Kingdom | 175/67 |

*Primary Examiner*—Bruce M. Kisliuk

*Attorney, Agent, or Firm*—Paul & Paul

[57] ABSTRACT

A device for forming an elongated hole in the ground, comprising a hollow, flexible conduit, a head (2') which is connected to one end of the conduit and which is fitted with at least one nozzle (5') through which fluid passing along the conduit under pressure is delivered in such a direction and under such pressure that when the head is not in rotation, the head will form a hole of curved configuration and such that when the head rotates about its longitudinal axis and the conduit is moved forwards in the hole-forming direction the head will form a substantially straight hole, the end of the head facing towards the hole-forming direction being provided with a surface which is positioned obliquely to the longitudinal axis of the head and which assists the head in forming a curved hole. The oblique surface is formed on a member (6') which is mounted on the head, the member being adjustably attached to the head in a manner to enable adjustments to be made to the angle of said member relative to the longitudinal axis of the head.

14 Claims, 2 Drawing Sheets

DEVICE FOR BORING HOLES IN THE GROUND

DESCRIPTION

1. Technical Field

The present invention relates to a device for boring holes in the ground.

The device includes a hollow, flexible conduit, a head which is connected to one end of the conduit and which is fitted with at least one nozzle through which fluid passing along the conduit under pressure is delivered in such a direction and under such pressure that when the head is not in rotation, the head will form a hole of curved configuration and such that when the head rotates about its longitudinal axis and the conduit is moved forwards in the hole-forming direction the head will form a substantially straight hole, the end of said head facing towards the holeforming direction being provided with a surface which is positioned obliquely to the longitudinal axis of the head and which assists the head in forming said hole.

2. Background Prior Art

Devices of this kind are known to the art, for instance from European patent application No. 86301590.5 (publ. No. 0 195 559) and UK patent application No. 8 225 486 (publ. No. 2 126 267A).

These known devices have been found to function satisfactorily in certain types of ground composition and less satisfactorily in other types of ground, particularly in ground which consists of loose soil and clay layers, due in part to the fact that the nozzle-carrying head is not steered in a path of sufficiently pronounced curvature as the head is advanced when not in rotation. The heads of these known devices are also of complicated configuration and become worn relatively quickly.

SUMMARY OF THE INVENTION

An object of the present invention is to improve devices of the aforesaid kind, and to provide such a device which will enable the head to be steered in a desired path, substantially irrespective of the nature of the ground in which the holes are formed, and which is reliable in operation and of simple construction.

This object is achieved by the inventive device having the characteristic features set forth in the following claims.

DESCRIPTION OF PREFERRED EMBODIMENTS

Figure 1:
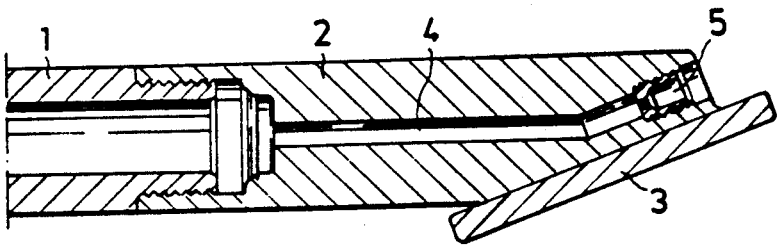
FIG. 1 is a sectional side view of a first embodiment of the inventive hole-forming device.

All of the hole-forming devices illustrated in the drawings are intended for connection to conventional equipment for advancing the device and forming holes or bores in the ground. This equipment, not shown in the drawings, includes a hollow conduit, of which a part is shown in FIG. 1 and referenced 1. One end of the conduit 1 is connected to the device whereas the other end of the conduit is connected to a machine which functions to urge the conduit in a direction towards the bottom of the hole being formed and to rotate the head when forming a straight hole. The machine also functions to deliver pressure fluid to the device and to detect the position of the device in the ground and to send signals to machine operator responsible for causing the machine to carry out these and other machine functions.

Figure 2:
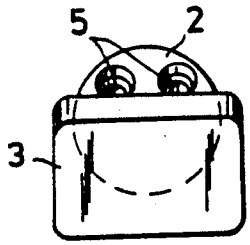
FIG. 2 is an end view of the device, seen from the right in FIG. 1.

The device illustrated in FIGS. 1 and 2 includes a substantially round cylindrical head 2 which is connected at its rear end to the conduit 1 and the front end of which, as seen in the forward drive direction of the device, is provided with a surface which is positioned obliquely to the longitudinal center axis of the head, and therewith to the longitudinal center axis of the conduit 1, and which is formed on a substantially flat plate 3. As will be seen from FIG. 2, the plate 3 has a forwardly located surface which is larger than the surface on the head 2 to which the plate 3 is attached and which is much larger than the cross-sectional area of the head. The angle of the plate 3 in relation to the longitudinal axis of the head 2 is between 10° and 40°, preferably about 20°. This angle cannot be changed in the case of the embodiment shown in FIGS. 1 and 2, since the plate 3 of this embodiment is welded to the head.

The head 2 is configured with one or more passages 4, which communicate with the conduit 1 and open at the forward end of the head, at a short distance from the plate 3, where a nozzle 5 of small through-flow area is mounted in each passage. The nozzles are directed so that the stream of fluid exiting therefrom will form essentially the same angle with the longitudinal axis of the head as the oblique surface.

The plate 3 of relative larger size than the head 2 in the embodiment illustrated in FIGS. 1 and 2 is operative to ensure that the head, when not in rotation, will be steered in the desired curved path, instead of in a straight path or a path of only small deviation, as would be the case if the plate were not provided.

Figure 3:
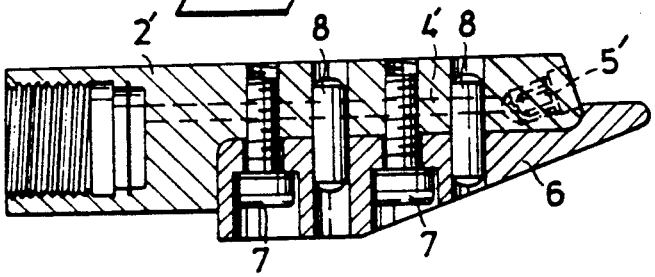
FIG. 3 is a sectional side view of a second embodiment of the inventive device.
Figure 4:
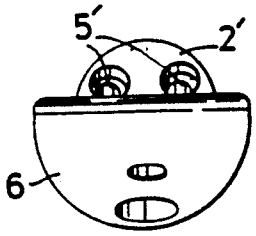
FIG. 4 is an end view of the device, seen from the right in FIG. 3.

FIGS. 3 and 4 illustrate an embodiment of the inventive device which differs from that illustrated in FIGS. 1 and 2, insomuch as the plate 3 of the earlier embodiment has been replaced with an insert. Those components of the FIG. 3 and 4 embodiment which correspond to the components of the embodiment illustrated in FIGS. 1 and 2 have been identified with the same reference numerals as those used in the earlier Figures, but with the inclusion of a prime. This insert, referenced 6, is inserted into a recess in the head 2' and is detachably secured in the recess by means of screws 7. Guide pins 8, which are passed through concentric holes in the head 2' and into the insert 6, prevent the screws from being subjected to heavy strain during operation. The insert 6 has a forwardly located oblique surface which corresponds in the main to the front surface of the plate 3 in FIG. 1 with respect to the angle of inclination of said surface and its size in relation to the head.

The insert 6 can be replaced with a similar insert of another configuration and having an oblique surface which is inclined at a different angle than the former surface.

The oblique surface on respective members 3 and 6 of the two embodiments described above with reference to FIGS. 1 and 2 and FIGS. 3 and 4 can both be provided with ridges (not shown) which extend generally parallel to the longitudinal axis of the head.

The embodiment illustrated in FIGS. 3 and 4 can, among other things, be adapted quickly to mutually different types of ground soil and the insert can be made of a tougher material than the head in general.

Figure 5:
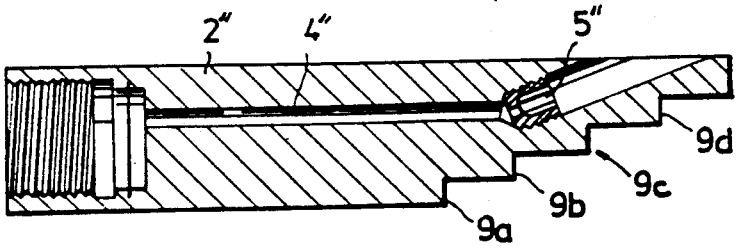
FIG. 5 is a sectional side view of a third embodiment of the inventive device.
Figure 6:
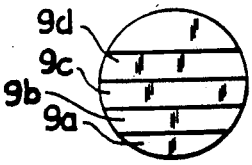
FIG. 6 is an end view of the device, seen from the right in FIG. 5.

FIGS. 5 and 6, in which components corresponding to the embodiments above described have been identified with like reference numerals to which a double-prime has been added, illustrate an embodiment of the inventive device which differs from the embodiment illustrated in FIGS. 1 and 2, in that the oblique surface is formed directly on the head 2" (at 9) and has a stepped configuration, said surface optionally being configured with a plurality of steps 9*a*–9*d*, or only one of these steps, as in the case of the embodiment shown in FIG. 5. When only one step is provided, on oblique surface or a surface transverse to the step located between the step and the front end of the head 2" may be flat. The steps will preferably form a right angle to the longitudinal axis of the head. Another difference between this embodiment and those aforesdescribed is that the passage or passages 4" open on the side surface of the head 2", this surface being substantially parallel with the longitudinal axis of the head, thereby protecting the nozzle or nozzles 5" against penetrating particles.

The embodiment illustrated in FIGS. 5 and 6 provides a better steering or guiding effect—when the device is not in rotation—than conventional devices of this kind, since the active guide surface area is increased without said surface extending beyond the peripheral confines of the hole-forming head.

Figure 7:
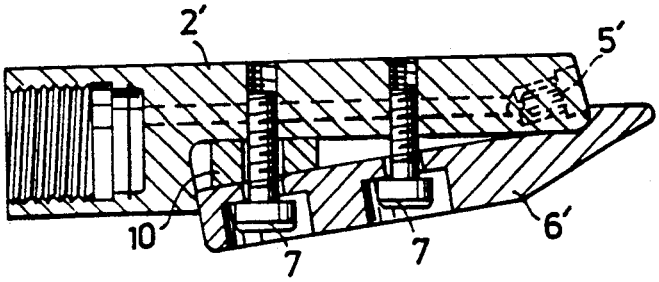
FIG. 7 is a sectional side view of a fourth embodiment of the inventive device.

FIG. 7 illustrates an embodiment of the inventive device which differs from that illustrated in FIG. 3 insomuch as the insert 6' in FIG. 7 may be tilted relative to the head 2', such as to change the angle formed by the front surface of the insert with the longitudinal axis of the head. This can be achieved, for instance, by providing hinge means and angle adjusting devices between the head and the insert, but in FIG. 7 such angle adjustments is made by inserting distance bodies, such as a washer 10, of varying thicknesses between the insert and the head 2'.

FIGS. 8–11 illustrate embodiments of the inventive device where members corresponding to the plate 3 or insert 6 are hinged to the head and adjusting means are provided between the members and the head for adjusting the members to desired angles relatively to the longitudinal axis of the head.

Figure 8:
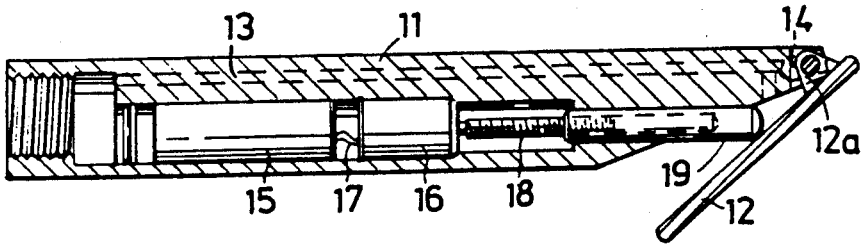
FIG. 8 is a sectional side view of a fifth embodiment of the inventive device.

In FIG. 8 there is shown a head 11 with a plate-like member 12 being hinged to the front of the head. The head 11 is provided with two parallel passages 13 which communicate with a conduit, such as the one shown in FIG. 1, and open at the forward end of the head where one nozzle 14 for each passage is mounted. Member 12 has an ear 12*a* rotatably mounted to the head 11 at a location between the two nozzles 14.

In the head 11 there is a space accommodating a radio signal receiver 15 including batteries and an electric motor 16 connected to the receiver 15 by cables 17. The shaft 18 of the motor 16 is provided with threads cooperating with internal threads in a sleeve 19 which is movable axially in the head but not permitted to rotate. The forward end of the sleeve 19 is adapted to contact member 12. In response to signals from a transmitter (not shown) operated by an operator on the ground the receiver 15 sends signals to the motor 16 to rotate the shaft 18 in order to move the sleeve 19 and thus swing the member 12 to an appropriate angle. The actuation of the member 12 may be performed during the operation of the device.

Figure 9:
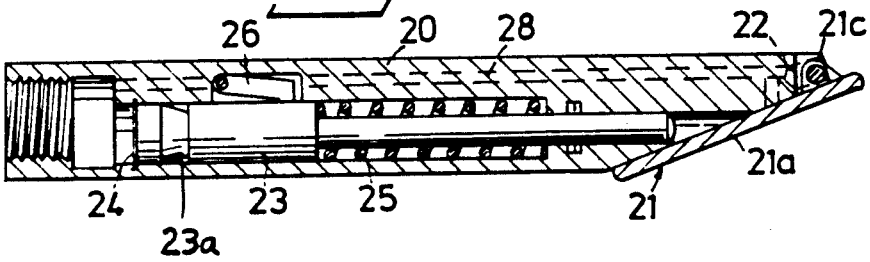
FIG. 9 is a sectional side view of a sixth embodiment of the inventive deivce in a first position.
Figure 10:
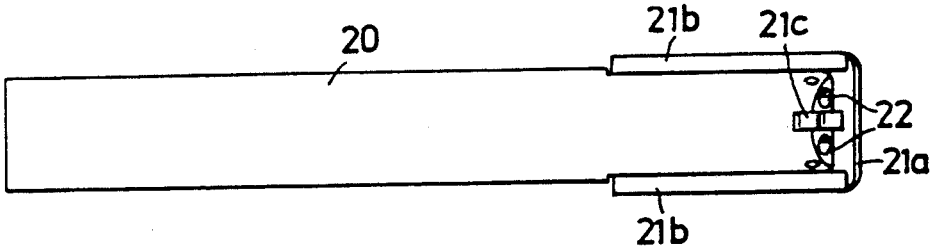
FIG. 10 is a top view of the device in FIG. 9.
Figure 11:
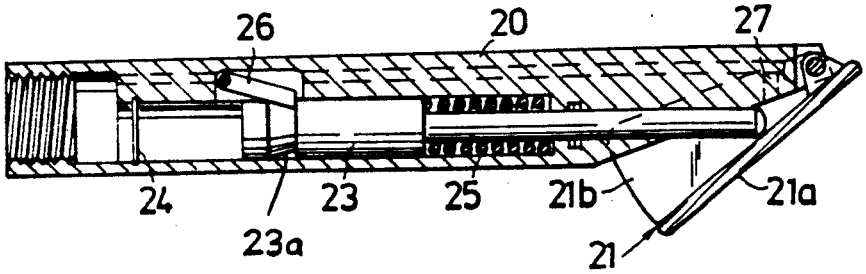
FIG. 11 is a sectional side view of the device shown in FIG. 9 in a second position.

In FIGS. 9–11 there is shown a head 20 with a U-shaped member 21 including an obliquely positioned plate 21*a* and two side flanges 21*b*. Member 21 has an ear 21*c* rotatably mounted to the head 20 at a location between two nozzles 22 communicating with two passages 28. The inner surfaces of the flanges 21*b* cooperate with surfaces on the head 20 to minimize stresses on the member 21 and its mounting means during the rotation of the head 20.

There is a space in the head 20 wherein a plunger 23 is axially movable. A detachable locking ring 24 prevents the plunger from moving to the left in FIGS. 9 and 11. A spring 25 urges the plunge against the ring 24. A pawl 26 is swingably mounted in the head and cooperates with the plunger 23 as will be described below.

When the fluid pressure in the conduit is normal the pressure is not sufficiently high to press the plunger 23 to the right from the position shown in FIG. 9 and the plate 21*a* will form a small angle to the longitudinal axis of the head 20 as shown in FIG. 9. When the fluid pressure is increased above a predetermined value the left end surface of the plunger 23 will be subjected to a pressure which moves the plunger 23 to the position shown in FIG. 11. During the movement the spring 25 is compressed, the pawl 26 is sliding on the surface of the plunger until the free end of the arm 26 falls into a recess 23*a* in the plunger and the member is swung to a position where the plate 21*a* forms a greater angle to the longitudinal direction of the head 20. The fluid pressure may then be decreased to a normal value and the plate 21*a* will remain in the position shown in FIG. 11.

When it is desired to restore the member 21 to the position shown in FIG. 9 the head is rotated 180° and the fluid pressure is increased to the above value. The pawl will then swing out from the recess 23*a* and when the pressure is decreased again the plunger 23 will be moved to the left and the plate 21*a* will be urged by the earth pressure against the plunger to take up the position shown in FIG. 9.

There is a nozzle 27 communicating with the passages 28. The nozzle 27 has a fluid flow passage less than that of the nozzles 22 and prevents earth, soil, etc. from gathering between the head 20 and the member 21. The fluid flow from the nozzle 27 will be reflected by the plate 21*a* and directed backwards along the head 20.

Although the invention has been exemplified with reference to a number of embodiments thereof, it will be understood that the invention is not restricted to these embodiments, but solely to the scope of the following claims.

We claim:

1. A device for forming an elongated hole in the ground, comprising a hollow, flexible conduit, a head which is connected to one end of the conduit and which is fitted with at least one nozzle through which fluid passing along the conduit under pressure is delivered in such a direction and under such pressure that when the head is not in rotation, the head will form a hole of curved configuration and such that when the head rotates about its longitudinal axis and the conduit is moved forwards in the hole-forming direction the head will form a substantially straight hole, the end of said head facing towards the hole-forming direction being provided with a surface which is positioned obliquely to the longitudinal axis of the head and which assists the head in forming a curved hole, characterized in that the oblique surface is formed on a member mounted on the head the member being adjustably attached to the head in a manner to enable adjustments to be made to the angle of said member relative to the longitudinal axis of the head without replacing the head.

2. A device according to claim 1 characterized in that said oblique surface is substantially flat and larger than the cross-sectional area of the head, the cross section being perpendicular to the longitudinal axis of the head.

3. A device according to claim 1, characterized in that the nozzle opens at a location on the head at a distance from the oblique surface, and delivers fluid in a direction which is substantially parallel to said surface.

4. A device according to claim 1, characterized in that the nozzle opens at a distance from the oblique surface in a surface on the head which is substantially parallel with the longitudinal axis of said head.

5. A device according to claim 1, wherein said member is pivotably attached to the head such that the angle formed between the member and the longitudinal axis of the head may be adjusted.

6. A device according to claim 1, wherein the member is held at the angle relative to the longitudinal axis of the head by a distance body of predetermined thickness positioned between the member and the head, the angle being adjustable by replacing the distance body with another distance body of a different thickness.

7. A device according to claim 1, wherein the member comprises a plate rotatably attached to the head.

8. A device for forming an elongated hole in the ground, comprising a hollow, flexible conduit, a head which is connected to one end of the conduit and which is fitted with at least one nozzle through which fluid passing along the conduit under pressure is delivered in such a direction and under such pressure that when the head is not in rotation, the head will form a hole of curved configuration and such that when the head rotates about its longitudinal axis and the conduit is moved forwards in the hole-forming direction the head will form a substantially straight hole, the end of said head facing towards the hole-forming direction being provided with a surface which is positioned obliquely to the longitudinal axis of the head and which assists the head in forming a curved hole, characterized in that the oblique surface is formed on a member mounted on the head, the member being adjustably attached to the head in a manner to enable adjustments to be made to the angle of said member relative to the longitudinal axis of the head without removing the device from the hole formed, the head including a radio signal receiver and a motor connected thereto, the motor being connected to means for actuating said member.

9. A device for forming an elongated hole in the ground, comprising a hollow, flexible conduit, a head which is connected to one end of the conduit and which is fitted with at least one nozzle through which fluid passing along the conduit under pressure is delivered in such a direction and under such pressure that when the head is not in rotation, the head will form a hole of curved configuration and such that when the head rotates about its longitudinal axis and the conduit is moved forwards in the hole-forming direction the head will form a substantially straight hole, the end of said head facing towards the hole-forming direction being provided with a surface which is positioned obliquely to the longitudinal axis of the head and which assists the head in forming a curved hole, characterized in that the oblique surface is formed on a member mounted on the head, the member being adjustable attached to the head in a manner to enable adjustments to be made to the angle of said member relative to the longitudinal axis of the head without removing the device from the hole formed, the head including an actuating means subjected to the fluid pressure in the conduit and actuating said member to adjust the angle between the member and the longitudinal axis of the head.

10. A device according to claim 9, characterized in that the means (23; 25) subjected to the fluid pressure in the conduit (1) includes a resilient element (25) preventing said means from moving the member (21) below a predetermined fluid pressure in the conduit (1).

11. A device for forming an elongated hole in the ground, comprising a hollow, flexible conduit, a head which is connected to one end of the conduit and which is fitted with at least one nozzle through which fluid passing along the conduit under pressure is delivered in such a direction and under such pressure that when the head in not in rotation, the head will form a hole of curved configuration and such that when the head rotates about its longitudinal axis and the conduit is moved forwards in the hole-forming direction the head will form a substantially straight hole, the end of said head facing in the hole-forming direction being provided with a surface which is positioned obliquely to the longitudinal axis of the head and which assists the head in forming a curved hole, characterized in that the oblique surface is formed on an insert removeably attached to the head, the insert being more wear-resistant than the material of the head.

12. A device for forming an elongated hole in the ground, comprising a hollow, flexible conduit, a head which is connected to one end of the conduit and which is fitted with at least one nozzle through which fluid passing along the conduit under pressure is delivered in such a direction and under such pressure that when the head is not in rotation, the head will form a hole of curved configuration and such that when the head rotates about its longitudinal axis and the conduit is moved forward sin the hole-forming direction the head will form a substantially straight hole, the end of said head facing in the hole-forming direction being provided with a surface which is positioned obliquely to the longitudinal axis of the head and which assists the head in forming a curved hole, characterized in that the oblique surface is stepped (at 9) with at least one part surface (*9a–9d*) extending substantially longitudinally of and/or transversally to the longitudinal axis of the head (2'').

13. A device for forming an elongated hole in the ground, comprising a hollow, flexible conduit, a head which is connected to one end of the conduit and which is fitted with at least one nozzle through which fluid passing along the conduit under pressure is delivered in such a direction and under such pressure that when the head is not in rotation, the head will form a hole of curved configuration and such that when the head rotates about its longitudinal axis and the conduit is moved forwards in the hole-forming direction the head will form a substantially straight hole, the end of said head facing towards the hole-forming direction being provided with a surface which is positioned obliquely to the longitudinal axis of the head and which assists the head in forming a curved hole, the surface comprised of a substantially flat plate having a width perpendicular to the longitudinal axis of the head, the width being greater than that of the head.

14. A device for forming an elongated hole in the ground, comprising a hollow, flexible conduit, a head which is connected to one end of the conduit and which is fitted with at least one nozzle through which fluid passing along the conduit under pressure is delivered in such a direction and under such pressure that when the head is not in rotation, the head will form a hole of curved configuration and such that when the head rotates about its longitudinal axis and the conduit is moved forwards in the hole-forming direction the head will form a substantially straight hole, the end of said facing towards the hole-forming direction provided with a stepped surface, the stepped surface comprising a plurality of steps, each step having a parallel surface and a normal surface, the parallel surface being substantially parallel to the longitudinal axis of the head with the normal surface being substantially perpendicular to the longitudinal axis of the head.

* * * * *

UNITED STATES PATENT AND TRADEMARK OFFICE

CERTIFICATE OF CORRECTION

PATENT NO. : 5,020,608

DATED : June 4, 1991

INVENTOR(S) : Anders Oden, et al

It is certified that error appears in the above-identified patent and that said Letters Patent is hereby corrected as shown below:

On the title page, line 15, Delete "[CH] Switzerland" as foreign priority country and substitute therefore --[SE] Sweden--.

Column 6, line 61, delete "transversally" and substitute therefore --transversely--.

Colunn 8, line 7, after the word "said" insert --head--.

Signed and Sealed this

First Day of December, 1992

*Attest:*

DOUGLAS B. COMER

*Attesting Officer*

*Acting Commissioner of Patents and Trademarks*